United States Patent [19]

Johnson

[11] 4,192,094

[45] Mar. 11, 1980

[54] SELF-PROPELLING TOY

[76] Inventor: Michael K. Johnson, 5314 Franklin Ave. - #7, Los Angeles, Calif. 90027

[21] Appl. No.: 916,798

[22] Filed: Jun. 19, 1978

[51] Int. Cl.[2] ..... A63H 17/00; A63H 29/08

[52] U.S. Cl. ..... 46/207

[58] Field of Search ..... 46/207, 206, 100

[56] References Cited

U.S. PATENT DOCUMENTS

| | | | |
|---|---|---|---|
| 2,219,154 | 10/1940 | Wahlberg | 46/207 |
| 2,575,743 | 11/1951 | Biggs | 46/207 |
| 3,060,634 | 10/1962 | Fisher | 46/207 |

*Primary Examiner*—Houston S. Bell

*Attorney, Agent, or Firm*—Phillips, Moore, Weissenberger, Lempio & Majestic

[57] ABSTRACT

A self-propelling toy comprises a ball-shaped housing having a tubular support member rotatably mounted therein. A weight is secured to and suspended from the support member and at least one rubber band is attached between the support member and the housing for storing-up and releasing energy therefrom when the rubber band is wound-up and the ball released.

15 Claims, 3 Drawing Figures

SELF-PROPELLING TOY

BACKGROUND OF THE INVENTION

This invention relates to a self-propelling toy of the type that may be wound-up and released to permit the toy to self-propel on the ground.

Conventional self-propelling toys, such as toy cars and the like, normally comprise a coil spring or the like which is adapted to be wound-up to store energy therein. Upon release of the toy, the toy will self-propel until the energy is spent. Toys of this type normally depend solely upon the weight of the toy to maintain it in contact with the ground during propelling thereof.

SUMMARY OF THE INVENTION

An object of this invention is to provide an improved self-propelling toy which is adapted to be energized expeditiously and which exhibits the ability to maintain close ground contact and traction during self-propelling thereof.

The toy comprises a housing having a support member rotatably mounted therein and weight means secured to the support member and spaced therefrom at a predetermined radial distance. A drive means is interconnected between the housing and the support member for storing-up energy therein when the support member and weight means are rotated in one direction relative to the housing and for releasing the energy to rotate the housing in a second direction when the toy is released by the operator.

BRIEF DESCRIPTION OF THE DRAWINGS

Other objects of this invention will become apparent from the following description and accompanying drawings wherein.

DETAILED DESCRIPTION OF THE INVENTION

Figure 1:
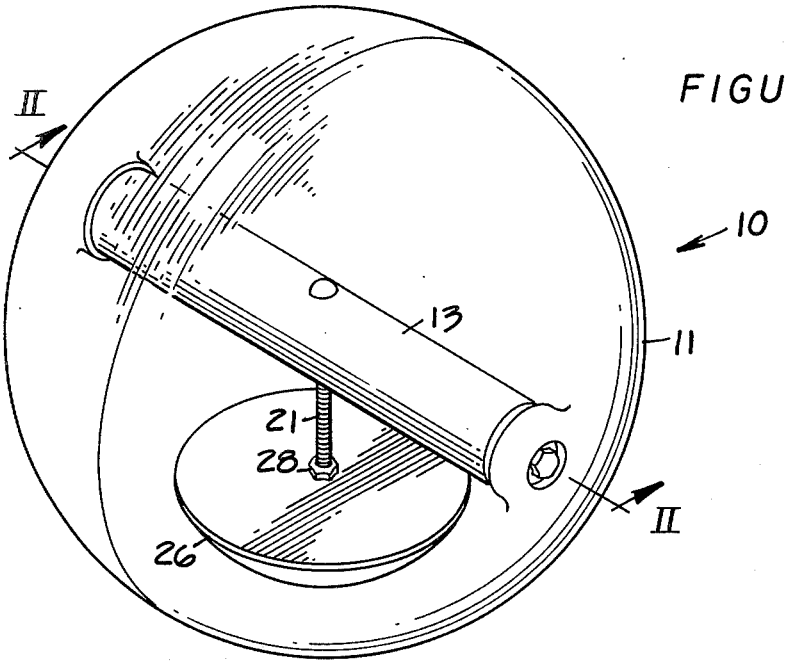
FIG. 1 is an isometric view of a toy embodying this invention.
Figure 2:
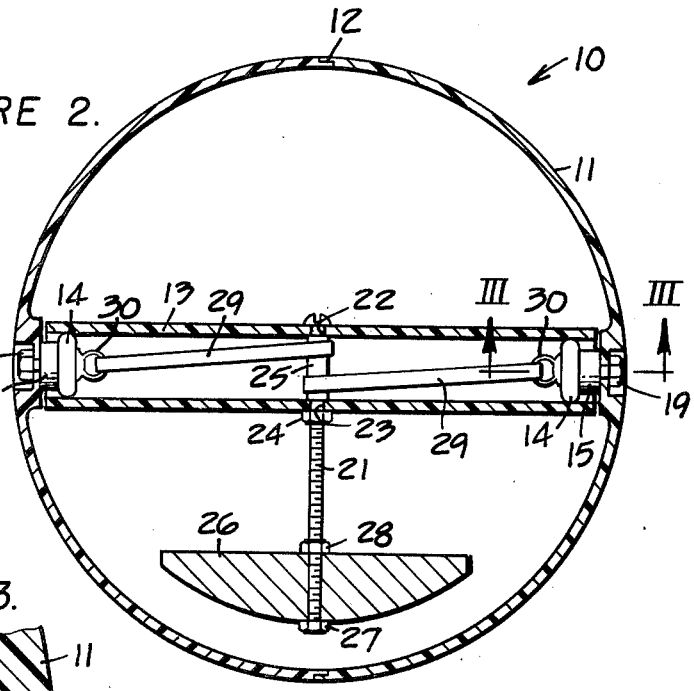
FIG. 2 is a cross-sectional view through the toy, taken in the direction of arrows II—II in FIG. 1.

FIGS. 1 and 2 illustrate a toy 10 comprising a spherical housing 11 which may be composed of a clear plastic material, for example. The housing is thus in the form of a ball which may comprise a pair of semi-spherical parts suitably secured together at a circumferentially extending seam 12 by standard adhesive or the like. A tubular support member 13 is rotatably mounted within the housing at diametrically opposed points thereon.

Figure 3:
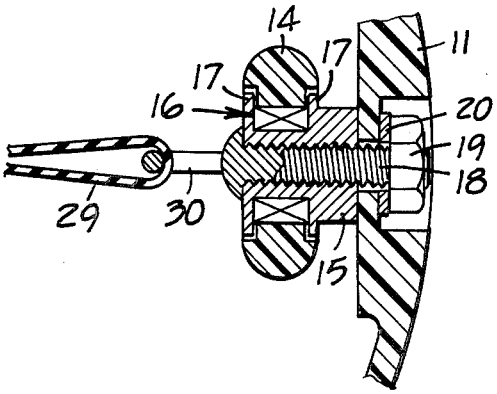
FIG. 3 is an enlarged sectional view, taken in the direction of arrows III—III in FIG. 2.

Each end of the support member is mounted on a roller 14 which is, in turn, rotatably mounted on an annular collar 15. As shown in FIG. 3, annular bearing means 16, such as a roller or ball bearing assembly, may be utilized to rotatably mount the roller on the collar. The collar has a pair of axially spaced radial flanges 17 formed integrally thereon for limiting axial movement of the roller.

The collar is threadably mounted on a screw 18 and is disposed interiorly of the housing. A nut 19 and lock washer 20 are suitably mounted on the end of the bolt which projects exteriorly of the housing, as more clearly shown in FIG. 3. It should be noted that the periphery of roller 14 is preferably rounded at 20 so that as spherical housing 11 flexes during rolling thereof on the ground, that limited universal movement is afforded between support member 13 and the rollers whereby bearings 16 will not tend to bind.

Referring to FIG. 2, a second screw 21 extends through aligned holes 22 and 23 formed through the sidewalls of support member 13 and is secured thereto by a nut 24. A plastic tube 25 is preferbly mounted on the bolt and extends between openings 22 and 23 for purposes hereinafter explained. A weight means 26, composed of lead or the like, is secured to an outer end of screw 21 by a pair of nuts 27 and 28. The weight means is preferably disposed at a predetermined and substantial distance from the rotational axis of support member 13 and closely adjacent to housing 11 for purposes hereinafter more fully explained.

A drive means, preferably comprising one or a pair of rubber bands 29 and 30, is interconnected between the housing and the support member for storing-up energy therein when the support member and weight means are rotated in one direction relative to the housing. As described hereinafter, such energy is released to rotate the housing in a second direction opposite to such first direction and relative to the support member and the weight means when the ball is released and permitted to propel itself under its own power.

Each rubber band is suitably secured to an eyelet 30 which, in turn, is secured to a respective bolt 18 (FIG. 3). The opposite end of each rubber band is mounted on tube 25 whereby a holding of housing 12 and relative rotation of support member 13 and weight 26 will function to twist the rubber bands to store-up energy therein. Alternatively, a single rubber band having opposite ends thereof anchored to eyelets 30 and intermediate strand portions disposed on opposite sides of tube 25 could be utilized.

In operation, a person intending to permit self-propelling of toy 10 need only hold opposite sides of housing 11 and rotate support member 13 and weight 26 relative thereto. Upon sufficient twisting of rubber bands 29 to store-up energy therein, throwing of the ball on the ground will function to permit housing 11 to rotate in a direction opposite to which support member 13 is rotated to wind-up the rubber bands, e.g., upon throwing of the ball in the proper orientation away from the person will permit the ball to return on its own accord. Weight 26, being positioned substantially radially outwardly from the rotational axis of support member 13 and adjacent to housing 11, will function to maintain the center of gravity of the ball substantially low relative to ground level to maintain the ball in contact with the ground to provide a high degree of traction therewith. In addition, the mass and relatively low disposition of the weight induces a substantial reaction force to relatively light housing 11 for driving the ball. The low center of gravity thus provided, wherein the weight of the ball is suspended on non-flexing support member 13, aids in maintaining the axis of rotation parallel to ground level to induce the ball to roll in a straight line. Although a plurality of circumferentially spaced weights could be mounted on support member 13, a single weight is preferred to provide the above-described desiderata.

In one specific embodiment of this invention, housing 11 and weight 26 each closely approximated 0.5 lb. In addition, the housing had an outside diameter approximating 7.5 ins., support member had an outside diameter of 1.0 in. and the radial distance between the center of the weight and the rotational axis of the support member approximated 2.25 ins.

As briefly mentioned above, rounded periphery 20 of each roller 14 (FIG. 3) permits slight torsional movement of support member 13 relative to the rollers, whereby bearings 16 will not tend to bind. It should be understood that other drive means may be substituted in lieu of rubber bands 29 for storing energy and thereafter releasing such energy to propel the ball. For example, suitably arranged coil or torsion springs could be connected between support member 13 and eyelets 30 for this purpose. Also, although a spherical housing 11 is preferred, it should be understood that other shapes (e.g., cylindrical) could be employed. Likewise, other changes to the above-described toy could be made within the skill of the art while yet maintaining the scope of invention hereinafter claimed.

It should be noted in FIG. 2 that the ends of support member 13 are disposed closely adjacent to interior surfaces of housing 11. The separation clearance between each end of the support member and the housing can be closely controlled to prevent the housing from permanent deformation or fracturing. In particular, upon the winding-up of rubber bands 29 approaching their maximum, desired tension, portions of the somewhat flexible housing will pinch-down on the respective ends of the support member to provide stop means to close the clearances whereby further winding of the bands is prevented. The frictional engagement as between the housing and ends of the support member will release and the clearances re-established to permit relative rotation of the ball with respect to the support member upon release of the ball.

I claim:

1. A self-propelling toy comprising a housing, a tubular support member rotatably mounted within said housing, roller means for rotatably mounting each end of said support member on said housing and disposed within said support member, weight means secured to said support member and spaced therefrom at a predetermined distance, and drive means interconnected between said housing and said support member for storing-up energy therein when said support member and said weight means are rotated in one direction relative to said housing and for releasing such energy to rotate said housing in a second direction opposite to said first direction and relative to said support member and said weight means upon release of said toy on the ground.

2. The toy of claim 1 wherein said housing is spherically shaped.

3. The toy of claim 2 wherein said support member is rotatably mounted at diametrically opposed points on said housing.

4. The toy of claim 1 wherein said drive means is disposed within said tube.

5. The toy of claim 1 wherein said weight means comprises a single weight secured to and suspended from said support member.

6. The toy of claim 5 wherein said weight is secured intermediate the length of said support member.

7. The toy of claim 5 wherein said weight is secured to said support member by a screw extending therethrough and wherein said drive means is connected to said screw.

8. The toy of claim 1 wherein said drive means comprises at least one rubber band interconnected between said housing and said support member.

9. The toy of claim 1 wherein said roller means comprises a roller rotatably mounted on said housing and disposed internally thereof, the periphery of said roller being rounded.

10. The toy of claim 9 wherein said roller is rotatably mounted on a collar disposed internally of said housing and fastening means releasably securing said collar to said housing.

11. The toy of claim 1 further comprising stop means for preventing a storing-up of energy in said drive means past a maximum value to prevent permanent deformation of said housing.

12. The toy of claim 11 wherein said housing is at least partially composed of a flexible material and wherein said stop means comprises portions of said housing mounting said support member thereon which are spaced-apart from ends of said support member to provide clearances therebetween when the energy of said drive means is maintained below said maximum value.

13. A self-propelling toy comprising a housing at least partially composed of a flexible material, a support member rotatably mounted within said housing, weight means secured to said support member and spaced therefrom at a predetermined distance, drive means interconnected between said housing and said support member for storing-up energy therein when said support member and said weight means are rotated in one direction relative to said housing and for releasing such energy to rotate said housing in a second direction opposite to said first direction and relative to said support member and said weight means upon release of said toy on the ground, and stop means for preventing a storing-up of energy in said drive means past a maximum value to prevent permanent deformation of said housing.

14. The toy of claim 13 wherein said stop means comprises portions of said housing mounting said support member thereon which are spaced-apart from ends of said support member to provide clearances therebetween when the energy of said drive means is maintained below said maximum value.

15. The toy of claim 13 wherein said housing is composed of a thin-walled plastic material.

* * * * *